United States Patent [19]

Hoff et al.

[11] Patent Number: 4,887,451

[45] Date of Patent: Dec. 19, 1989

[54] SELF-RETRACTING MODULAR COLLET ASSEMBLY

[75] Inventors: Steven R. Hoff, New Haven, Ind.; Larry L. Zuber, Antwerp, Ohio

[73] Assignee: Dana Corporation, Toledo, Ohio

[21] Appl. No.: 230,629

[22] Filed: Aug. 10, 1988

[51] Int. Cl.[4] ..... B21D 41/04

[52] U.S. Cl. ..... 72/402; 29/237

[58] Field of Search ..... 72/402, 416, 452; 29/237

[56] References Cited

U.S. PATENT DOCUMENTS

| | | | |
|---|---|---|---|
| 2,311,662 | 2/1943 | Hunziker | 72/402 |
| 3,093,182 | 6/1963 | Vanderhoof | 72/402 |
| 3,762,209 | 10/1973 | Herndon et al. | 72/402 |
| 4,034,593 | 7/1977 | Patel | 72/402 |
| 4,107,964 | 8/1978 | Smith | 72/402 |
| 4,227,395 | 10/1980 | Plavsity | 72/402 |
| 4,250,607 | 2/1981 | Lillbacka et al. | 29/237 |
| 4,309,892 | 1/1982 | Currie | 72/402 |
| 4,357,822 | 11/1982 | Patel | 72/402 |
| 4,470,290 | 9/1984 | Jungesjo | 72/402 |
| 4,472,959 | 9/1984 | Fencl | 72/402 |
| 4,515,006 | 5/1985 | Stanley | 72/402 |
| 4,527,414 | 7/1985 | Jurkovic et al. | 72/402 |
| 4,625,539 | 12/1986 | Brooks et al. | 72/402 |

FOREIGN PATENT DOCUMENTS

| | | | |
|---|---|---|---|
| 1380634 | 1/1975 | United Kingdom | 29/237 |

*Primary Examiner*—Daniel C. Crane

*Attorney, Agent, or Firm*—F. B. McDonald

[57] ABSTRACT

A collet assembly includes a self-retraction system for convenience of use and quick adjustment. In a preferred form, the collet assembly is releasably retained against a top pressure ring normally biased apart from a base ring. The pressure ring includes a plurality of elongated detents which extend axially from the pressure ring, each adapted for insertion into a detent-receiving socket of one die segment contained in an elastomeric cage. Each detent is radially moveable with respect to the pressure ring, such that as the die segments are contracted radially inwardly, the detents hold the segments to the pressure ring but permit movement of the segments radially with respect to the ring. After each crimping operation, the detents, which are normally spring biased to their radially outermost position, will return the die segments to a fully opened position. In addition, the pressure ring is retracted upwardly away from the base ring by means of an axial spring biasing system to provide clearance for removing the finished crimped product from the collet assembly.

12 Claims, 1 Drawing Sheet

SELF-RETRACTING MODULAR COLLET ASSEMBLY

BACKGROUND OF THE INVENTION

This invention relates to devices adapted to facilitate in-the-field crimping of metallic fitting assemblies onto the ends of elastomeric tubing or hose. More particularly, the invention relates to the use of crimping tools, including modular contractible collets which have special features related to convenience of operation.

Contractible collets operate by plastically deforming or crimping an outer metallic sleeve of a fitting around a hose end to cause the hose to be compressed between the outer sleeve and a fitting nipple positioned inside of the hose. Such devices are particularly suited for relatively low volume work, as, for example, make-up of replacement hoses in the field or at the point of use. Most prior art collet devices are devoid of any self-retracting aspects, and as a result have been relatively cumbersome to use. Thus, not only do collet die segments remain in contact with the fitting sleeve after crimping, but contractible collet assemblies typically remain lodged within the normally tapered interior bore of the base ring. This situation has not permitted ease of removal of the crimped fitting assembly after the crimping process. As a result, such devices have been awkward to use, and with intermittent and necessary adjustment, the operation of these devices has been inconvenient at best.

SUMMARY OF THE INVENTION

The invention described herein provides a modular contractible collet assembly which is self-retracting. Moreover, the collet assembly is retained against the pressure ring at all time both during and after the crimping process. In a preferred form, the device of the present invention includes a plurality of elongated detents extending axially downwardly from a pressure ring, each of the detents including a radially oriented groove. The grooves are adapted for engagement with metallic spring plungers disposed in sockets within selected die segments of a pair of collet halves. The detents are positioned in radially moving anchors which are normally spring biased to their radially outermost position within the pressure ring.

Also in the preferred form, the pressure ring is axially biased away from the base ring by springs positioned in a plurality of axial bores spaced about the circumference of the base ring. Each bore of the base ring contains a reduced diameter portion having a top surface disposed for supporting one helical spring along with a bolt shaft coaxially positioned with the spring in each base ring bore. Each bolt shaft has one end thereof secured to the pressure ring and includes a head at the other end disposed for engagement with the bottom of the reduced diameter portion of the base ring bore. Thus, axial spring biased movement of the pressure ring from the base ring is limited by engagement of the head of the bolt with the reduced diameter portion of each base ring bore.

DETAILED DESCRIPTION OF A PREFERRED EMBODIMENT

Figure 1:
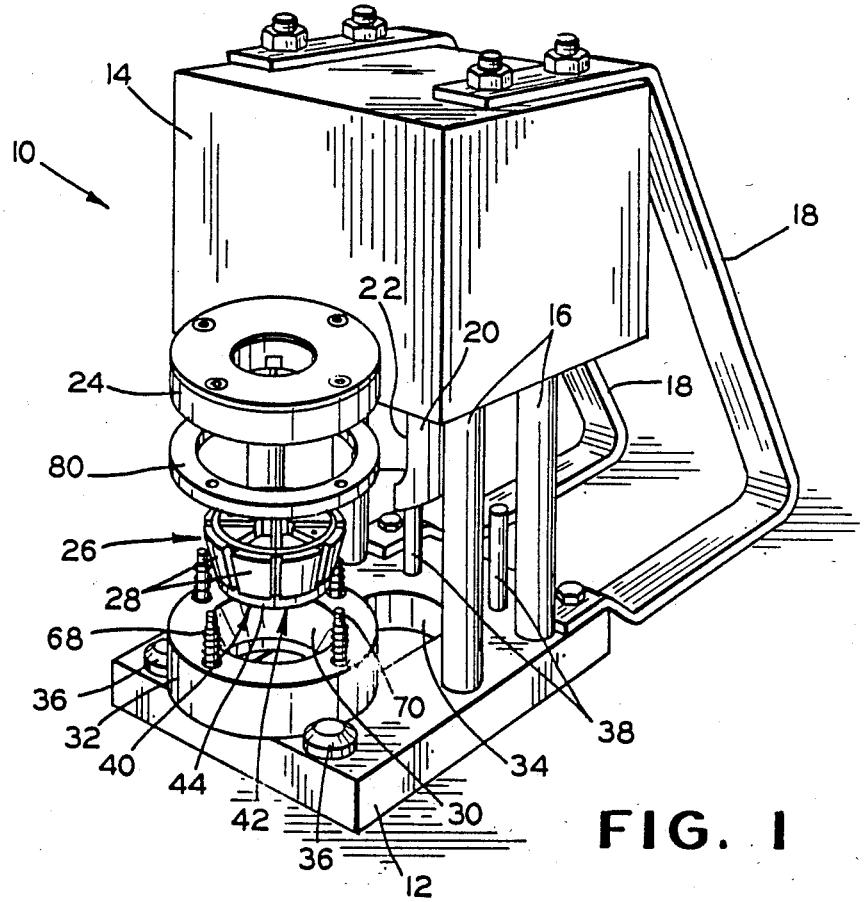
FIG. 1 is a perspective view of a crimping device adapted for mechanically securing a metallic fitting assembly to one end of an elastomeric hose, wherein a preferred embodiment of the self-retracting modular collet assembly of the present invention is shown.

Referring initially to FIG. 1, a portable field operated crimping device 10 is shown. The device 10 includes a bed plate 12, and a hydraulic ram actuator assembly 14 fixed to and supported over the bed plate by columns 16. A pair of rear supports 18 are utilized to provide additional stability to the portable device 10.

The device 10 includes a hydraulic ram 20 which moves reciprocally in a vertical direction from the hydraulic actuator assembly 14. The ram 20 includes a clearance slot 22 which is provided for accommodating elbows as well as other metal fitting members which have portions extending radially outwardly during the crimping process. The ram 20 is adapted for making contact with a pressure ring 24, which in turn makes contact with a collet assembly 26. The collet assembly 26 includes a plurality of die segments 28 which, by means hereinafter described, cause metal fittings to be permanently secured to hose ends by plastically deforming or crimping an outer sleeve of the fitting about the hose end in order to cause the hose to be compressed between the outer sleeve and a fitting nipple (not shown) positioned inside of the hose.

Figure 2:
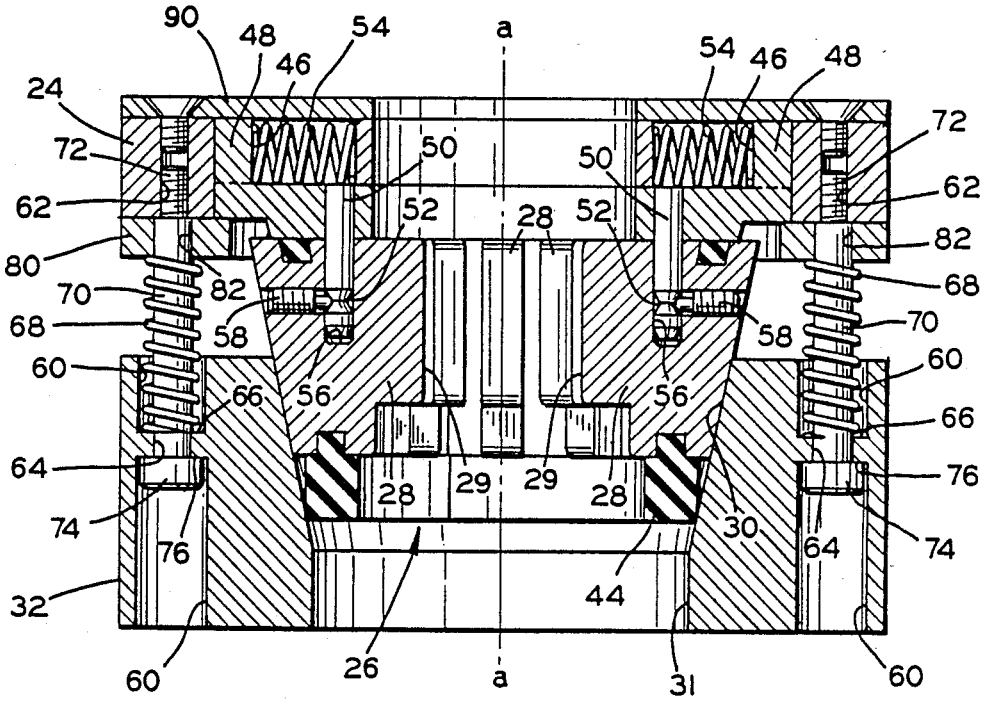
FIG. 2 is a cross sectional view of a preferred embodiment of the modular collet assembly, along with views of a pressure ring and a base ring having a tapered interior bore against which the collet assembly reacts.

Referring now also to FIG. 2, each of the die segments 28 (only two of which are shown) incorporates a radially innermost fitting contact surface 29 designed to engage and crimp a fitting sleeve along a generally vertical crimping axis "a—a". For this purpose a base ring 32 includes a frustoconically tapered interior bore 30 which causes the die segments of the collet assembly to be cammed radially inwardly, constricting the die segments around a fitting sleeve until the sleeve is permanently crimped onto a hose end.

A clearance slot 34 (FIG. 1) is provided in the bed plate 12 of the device 10 for facilitating the placement of a hose end, including a length of hose and a crimp fitting (neither shown), into the collet assembly 26 by passing same through the slot 34 of the bed plate and up through a straight portion 31 of the otherwise tapered interior bore 30. For this purpose, the base ring 32 may be positioned forwardly against a pair of forward stops 36 which are screwed or otherwise fastened to the bed plate 12. A pair of rear stops 38 provides a means for subsequently centering the collet assembly 26, sandwiched between the base and pressure rings, under the ram 20 for purposes of preparing for crimping. Referring now more particularly to the preferred embodiment of FIG. 1, the collet assembly 26 includes a pair of mating semi-circular collet assembly halves 40 and 42 which facilitate the insertion and subsequent handling of the hose end and fitting member to be crimped. Each of the collet halves include four die segments contained in an elastomeric cage 44. The cage 44 of each of the pair of collet assembly halves provides a resilient contractible spacer for the die segments, at the same time retaining adjacent segments in predetermined angular relationships with respect to each other at all times during the crimping process.

Referring now particularly to FIG. 2, the pressure ring 24 includes a plurality of radial slots 46 which contain detent slide anchors 48. In the preferred embodiment, one pair of detent slide anchors 48 are utilized, oriented 180 degrees apart of each other, each anchor supporting a detent 50 which extends downwardly toward the base ring 32. Also positioned within each radial slot 46 is a small helical spring 54 which bears against the slide anchor to normally bias the anchor to its radially outermost position within the slot. Each detent 50 is adapted for insertion into one detent socket 56 provided in at least one segment 28 of each one of the collet assembly halves 40 and 42.

As will be apparent in FIG. 2, each detent includes a radially extending groove 52 adapted for engagement, upon insertion into the socket 56, with a radially extending metallic spring plunger 58 contained within its associated segment 28. The spring plunger 58 provides an axial resistance for selective retention of the detent. Retraction may be effected by a manual pull of the collet halves 40 and 42 from the detents 50 for changing the collet halves as desired.

A plurality of circumferentially positioned helical biasing springs 68 are contained within base ring bores 60. Thus, whenever the hydraulic ram 20 is retracted upwardly from the pressure ring 24, the ring 24 will be urged upwardly by mean of the springs 68. As will be apparent from FIG. 2, the bores 60 are coaxial with the pressure ring bores 62, the latter of which contain screw threads. The base ring bores 60 each include a reduced diameter portion 64, the top surface 66 of which provides support for one of the springs 68. A bolt shaft 70 extends upwardly through each spring 68, each shaft having a reduced diameter portion 72 which is screwed for securement into one of the threaded pressure ring bores 62. The bottom surface of each reduced diameter portion is adapted to engage a bolt head 74, each of which is integral to a bolt shaft 70. The bolt head 74 thus will limit the amount of retraction of the pressure ring 24 upwardly from the base ring 32.

It will thus be appreciated by those skilled in the art that the base ring biasing springs 68 will provide a system for normally axially biasing the pressure ring 24 and collet assembly 26 out of contact engagement with the tapered interior bore 30 of the base ring. Moreover, it will be further appreciated that the slide anchor springs will operate to normally bias the detents 50 radially outwardly upon such retraction of the pressure ring 24. The result is a system which offers a self-retracting collet assembly for use in the crimping device 10.

The present invention therefore provides a spring biasing system which automatically raises the collet assembly 26 from the tapered bore 30 of the base ring 32 upon completion of the crimping process, holding the assembly 26 against the ring 24 by means of the detents 50.

Another convenience of the present invention is the use of a plurality of interchangeable spacer rings 80, each of a predetermined thickness, and disposed for use one at a time. This feature permits the amount of radial compression of the die segments 28 to be selectively controlled, to the extent that the ram 20 can only compress the pressure ring downwardly until such time as the spacer ring 24 engages the base ring 32. It will be appreciated by those skilled in the art that the spacer ring apertures 82 will allow for passage of the bolt shafts 70, and that the spacer ring areas immediately adjacent the apertures 82 will provide bearing surfaces for the springs 68 for raising the pressure ring 24 away from the base ring 32 upon retraction. Finally, for convenience, the pressure ring incorporates a removable plate at its top surface for access to the slide anchors and slide anchor springs 48 and 54, respectively.

Although only one preferred embodiment has been described herein, the following claims envision numerous other embodiments not shown nor particularly described herein.

What is claimed is:

1. In a device adapted for crimping a metallic fitting to one end of an elastomeric hose, said device including a base ring having a frustoconically tapered interior bore defining an axis, a plurality of mating collet assemblies, each of said collet assemblies comprising at least one die segment supported in an elastomeric cage, each of said segments being circumferentially spaced apart but contractible together in said cages, said crimping device further including a ram pressure ring movable toward said base ring and adapted for selectively urging said collet assemblies axially against said interior bore of said base, thereby radially translating said die segments inwardly toward said axis; an improvement comprising retraction means for removing said collet assemblies from said interior bore of said base upon completion of said crimping, said retraction means comprising releasable retention means for attaching each of said collet assemblies to said pressure ring, axial spring biasing means for removing said pressure ring from said base ring, and radial spring biasing means for urging said collet assemblies to their radially outermost positions, whereby said collet assemblies are axially retracted away from said base ring and are radially translated away from said axis upon completion of said crimping.

2. The crimping device of claim 1 wherein said releasable retention means for attaching said collet assemblies to said pressure ring comprises a plurality of elongated detents extending axially toward said base ring from said pressure ring, each of said detents comprising a radially oriented groove about its periphery.

3. The crimping device of claim 2 wherein each of said detents is axially secured to, but radially moveable with respect to, said pressure ring.

4. The crimping device of claim 3 further comprising a plurality of slide anchors, each positioned within a radial slot in said pressure ring, wherein each one of said detents is supported rigidly to one slide anchor, wherein each slide anchor is normally spring biased to a radially outermost position in said pressure ring.

5. The crimping device of claim 4 wherein each of said collet assemblies comprises at least one die segment having one axially oriented socket for receiving one of said detents extending from said pressure ring, said socket containing radially moving means for releasably engaging said groove of said one detent.

6. The crimping device of claim 5 wherein said radially moving means comprises a spring plunger.

7. The crimping device of claim 6 wherein said base ring comprises means for normally axially spring biasing said pressure ring and collet assemblies out of engagement with said base ring.

8. The crimping device of claim 7 wherein said means for normally axially spring biasing said pressure ring and collet assemblies out of engagement with said base ring comprises a plurality of helical springs positioned in bores circumferentially spaced about said base ring, each bore of said base ring containing a reduced diameter portion having a top surface disposed for supporting one spring, said biasing means further comprising a bolt shaft extending coaxially through each spring positioned in each base ring bore, each bolt shaft having one end secured to said pressure ring and having a head at the other end disposed for engagement with a bottom surface of said reduced diameter portion of said base ring bore for limiting the amount of retraction of said pressure ring from said base ring.

9. The crimping device of claim 8 further comprising a spacer ring interposed between said pressure ring and said base ring, said spacer ring slidable along said bolt shafts, said spacer ring being retained against said pressure ring by said axial biasing springs.

10. The crimping device of claim 9 wherein said spacer ring comprises a plurality of interchangeable members of predetermined thicknesses, each disposed for use one at a time, whereby the axial movement of and radial translation of said collet assemblies with respect to said interior bore of said base ring may be selectively controlled.

11. In a device adapted for crimping a metallic fitting to one end of an elastomeric hose, said device including a base ring having a frustoconically tapered interior bore defining an axis, a plurality of mating collet assemblies, each of said collet assemblies comprising at least one die segment supported in an elastomeric cage, each of said segments being circumferentially spaced apart but contractible together in said cages, said crimping device further including a ram pressure ring movable toward said base ring and adapted for selectively urging said collet assemblies axially against said interior bore of said base, thereby radially translating said die segments inwardly toward said axis; an improvement comprising means for attaching said collet assemblies to said pressure ring including means for allowing radial movement of said collet assemblies with respect to said pressure ring while maintaining axial alignment of said collet assemblies during crimping, wherein said means for attaching said collet assemblies includes a spring for biasing said collet assemblies radially outwardly.

12. The crimping device of claim 11 further comprising means for biasing said pressure ring away from said base ring.

* * * * *